US008925526B2

(12) United States Patent
Anders et al.

(10) Patent No.: US 8,925,526 B2
(45) Date of Patent: Jan. 6, 2015

(54) INTERNAL COMBUSTION ENGINE AND METHOD OF OPERATING SUCH ENGINE

(75) Inventors: Jonathan W. Anders, Peoria, IL (US); Scott B. Fiveland, Metamora, IL (US); Carl-Anders Hergart, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 613 days.

(21) Appl. No.: 13/263,303

(22) PCT Filed: Dec. 17, 2009

(86) PCT No.: PCT/US2009/068469

§ 371 (c)(1),
(2), (4) Date: Jan. 20, 2012

(87) PCT Pub. No.: WO2010/075167

PCT Pub. Date: Jul. 1, 2010

(65) Prior Publication Data

US 2012/0103311 A1 May 3, 2012

Related U.S. Application Data

(60) Provisional application No. 61/193,855, filed on Dec. 22, 2008.

(51) Int. Cl.

| | |
|---|---|
| ***F02M 15/00*** | (2006.01) |
| ***F02B 25/00*** | (2006.01) |
| ***F02B 33/22*** | (2006.01) |
| ***F02B 21/00*** | (2006.01) |
| ***F02D 39/04*** | (2006.01) |
| *F02M 69/04* | (2006.01) |

(52) U.S. Cl.

CPC ..... *F02B 33/22* (2013.01); *F02B 21/00* (2013.01); *F02D 39/04* (2013.01); *F02M 69/044* (2013.01); *F02M 69/045* (2013.01)

USPC ..... 123/542; 123/540; 123/70 R

(58) Field of Classification Search

USPC ..... 123/68, 542, 563

See application file for complete search history.

(56) References Cited

U.S. PATENT DOCUMENTS 2,594,845 A * 4/1952 Baumann ..... 60/609
4,476,821 A 10/1984 Robinson et al.

(Continued)

FOREIGN PATENT DOCUMENTS

GB 1044339 A 9/1966
WO 20110456642 4/2011

OTHER PUBLICATIONS

E. Musu, R. Rossi, R. Gentili, R. Reitz, CFD Study of HCPC Turbocharged Engine, Paper, Oct. 25, 2010, SAE International, Italy.

(Continued)

*Primary Examiner* — Lindsay Low
*Assistant Examiner* — Syed O Hasan
(74) *Attorney, Agent, or Firm* — Leydig, Voit & Mayer, Ltd.

(57) ABSTRACT

A method of operating a combustion engine including causing an intake stroke in a first cylinder, causing a compression stroke in the first cylinder thereby creating pressurized fluid and releasing pressurized fluid from the first cylinder. The method further includes cooling the released fluid, directing the cooled fluid into a second cylinder over a first period of time and injecting fuel into the second cylinder over a second period of time whereby the first and second periods of time at least partially overlap.

20 Claims, 2 Drawing Sheets

(56) References Cited

U.S. PATENT DOCUMENTS

| | | | | |
|---|---|---|---|---|
| 6,758,193 | B1 * | 7/2004 | Kincaid | 123/542 |
| 8,037,872 | B2 * | 10/2011 | Holler et al. | 123/542 |
| 2006/0124085 | A1 * | 6/2006 | Luttgeharm | 123/68 |

OTHER PUBLICATIONS

International Search Report for PCT/2009/068469, Mar. 11, 2010, 2 pp.

Written Opinion for PCT/2009/068469, Mar. 11, 2010, 4 pp.

* cited by examiner

INTERNAL COMBUSTION ENGINE AND METHOD OF OPERATING SUCH ENGINE

TECHNICAL FIELD

This disclosure relates to internal combustion engines in general and more particular to internal combustion engines operating on a split-cycle principle.

BACKGROUND

Split-cycle internal combustion engines are known in the art albeit in their early stages of development and realization. For example, WO03/008785 assigned to Scuderi Group is concerned with offsets to optimize the compression stroke in a split-cycle engine. The Scuderi Group has a range applications and patents in this field and although it is mentioned that the principle applies to CI engines, none of their applications and patents address some specific issues associated with split-cycle CI engines. The current disclosure is aimed at addressing at least some of the shortcomings of the prior art.

SUMMARY

In a first aspect there is disclosed a method of operating a combustion engine. The method comprises causing an intake stroke in a first cylinder and causing a compression stroke in the first cylinder thereby creating pressurized fluid which is released from the first cylinder. The method further includes cooling the released fluid, directing the cooled fluid into a second cylinder over a first period of time and injecting fuel into the second cylinder over a second period of time whereby the first and second periods of time at least partially overlap.

In a second aspect there is disclosed an internal combustion engine comprising a pair of first and second cylinders configured to operate a split-cycle, the first cylinder being configured to run the intake and compression strokes and the second cylinder of the pair being configured to run the power and exhaust strokes. The engine further includes a passage fluidly connecting the first and second cylinders and which is configured to enable transfer of pressurized fluid between the first cylinder and the second cylinder. A cooling arrangement is associated with the passage. The engine further includes a valve arrangement to control entry of the pressurized fluid into the second cylinder over a first period of time and a fuel injection arrangement is configured to inject fuel into the second cylinder over a second period of time. A control arrangement is configured to control at least the fuel injection arrangement such that the first and second time periods at least partially overlap.

In a third aspect there is disclosed a method of operating a combustion engine comprising causing a first intake stroke in a first cylinder, causing a compression stroke in the first cylinder thereby creating pressurized fluid and releasing pressurized fluid from the first cylinder. The method further includes cooling the released fluid, directing the cooled fluid into a second cylinder and injecting fuel into the second cylinder for combustion with the cooled fluid.

In a fourth aspect there is disclosed a method of operating a combustion engine comprising causing a first intake stroke in a first cylinder, causing a compression stroke in the first cylinder thereby creating pressurized fluid and releasing pressurized fluid from the first cylinder. The method further includes directing the pressurized fluid into a second cylinder for a first period of time and injecting fuel into the second cylinder for a second period of time wherein the first and second period of time at least partially overlap.

Other features and aspects of this disclosure will be apparent from the following description and the accompanying drawings.

DETAILED DESCRIPTION

Figure 1:
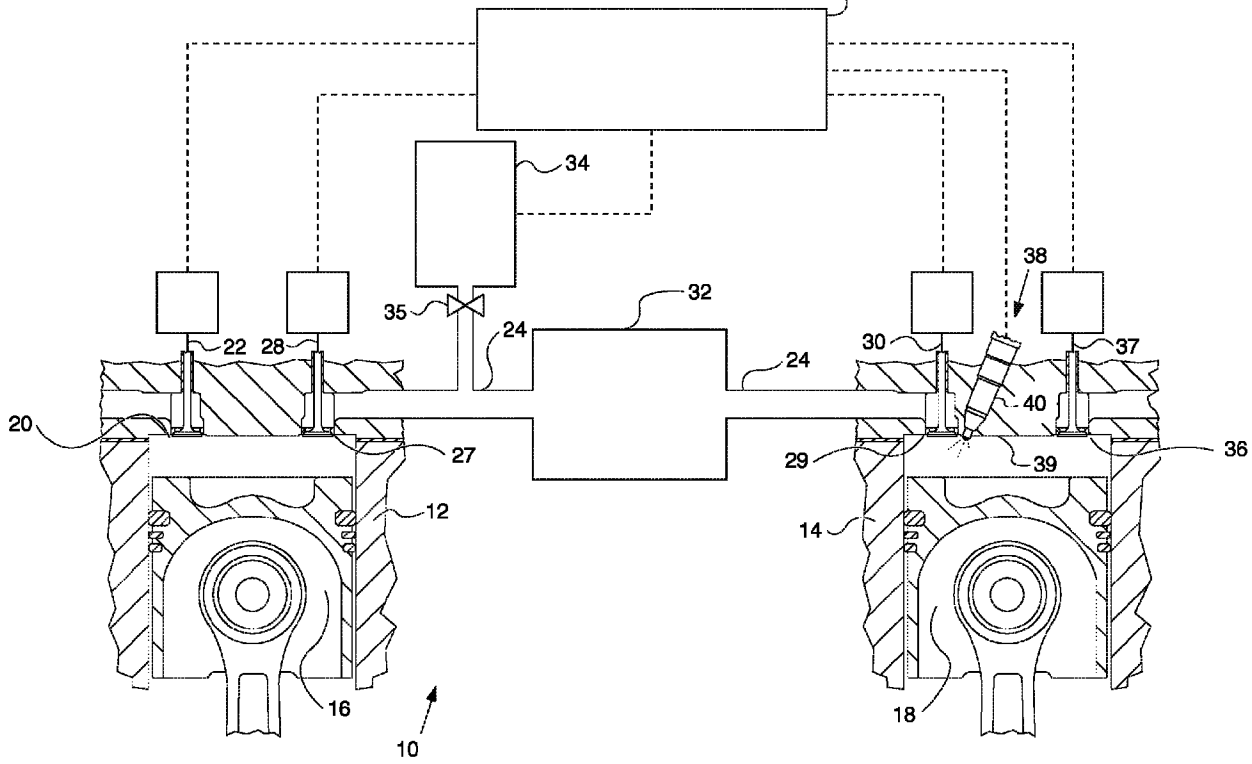
FIG. 1 is a schematical representation of a pair of cylinders and associated systems for a split-cycle combustion engine in accordance with the current disclosure.

Now referring to FIGS. 1 to 4, there is shown an exemplary embodiment of an internal combustion engine 10 configured to operate on a split-cycle process. The engine 10 may be provided with at least one pair of first and second cylinders 12 and 14. In a split-cycle process, a pair of first and second cylinders 12 and 14 together complete all the strokes of a cycle such as for example a four-stroke cycle. In a split four-stroke cycle, the first cylinder 12 runs the intake and compression strokes and the four-stroke cycle is completed by the second cylinder 14 which runs the power and exhaust strokes.

The first and second cylinders 12, 14 are provided with first and second pistons 16 and 18, respectively. The first and second cylinders 12, 14, and hence their respective pistons 16, 18, may have different diameters to realize certain desired compression ratios.

The first cylinder 12 may receive air and, if desired, recirculated exhaust gas (EGR) via an intake port 20. The intake of air during an intake stroke of the first piston 16 may be controlled via an intake valve arrangement 22.

During a compression stroke, the first piston 16 may pressurize the fluid or fluids in the first cylinder 12. A transfer passage 24 may fluidly connect the first and second cylinders 12, 14 and may be configured to enable transfer of pressurized fluid between the first and second cylinders 12, 14. Flow between the first and second cylinders 12, 14 and/or through the transfer passage 24 may be controlled via one or more arrangements such as, for example, a release port 27 and an associated release valve arrangement 28 and/or an inlet port 29 and an associated inlet valve arrangement 30. Additional valves may be employed if desired. The transfer passage 24 may include a cooling arrangement 32 configured. A cooling arrangement 32 may be associated with the transfer passage 24 to cool the flow of pressurized fluid through the transfer passage 24. In some embodiments the cooling arrangement 32 may include a flow-through cooler such that the pressurized fluid flowing through the transfer passage 24 flows through the cooler itself. In some embodiments the cooling arrangement 32 may be a jacket cooler and thereby indirectly cooling the pressurized fluid. In one embodiment the cooling arrangement is configured to cool the flow through the transfer passage by about 40-60° K.

A pressure storage device 34 may be fluidly connected to the transfer passage 24 to temporarily store pressurized fluid. The pressure storage device 34 may for example be a tank or an accumulator. In one embodiment the pressure storage device 34 and the cooling arrangement 32 may be integrated into one unit so as to simultaneously store and cool pressurized fluid. A pressure valve arrangement 35 may be provided to control flow of fluid to the pressure storage device 34.

The second cylinder 14 may be provided with an exhaust port 36 and an associated exhaust valve arrangement 37 for exhausting combustion products. The engine 10 may be provided with a fuel introduction arrangement. In the depicted embodiment, the fuel introduction arrangement is configured as a fuel injection arrangement 38 with at least one fuel injector 40. In other embodiments, however, the fuel introduction arrangement may introduce fuel to the second cylinder 14 in other ways. For example, a carburetor arrangement may be provided between the cooling arrangement 32 and the inlet port 29. Such an arrangement may be used independently or in combination with a fuel injection arrangement configured to inject fuel into the pressurized fluid entering the inlet port 29. Furthermore, in various embodiments, the fuel introduction arrangement may be configured to introduce different fuel types, such as diesel fuel, gasoline, natural gas, dual fuel arrangements, or other suitable fuel types.

The valve arrangements 22, 28, 30, 35 and 37 may be constructed as desired and may, for example, include mechanical, hydraulic, or electric actuators. The actual valve elements in the valve arrangements 22, 28, 30, and 37 are shown as poppet valves, but may be of any suitable construction such as for example disc valves, rotary disc valves, and/or rotary ball valves.

A control arrangement 42 may be used to actuate and/or control at least some of the valve arrangements 22, 28, 30, 35 and 37 and/or the fuel injection arrangement 38. The control arrangement 42 may include, for example, one or more electronic control units (as shown in FIG. 1) and/or one or more engine driven camshafts.

Figure 2:
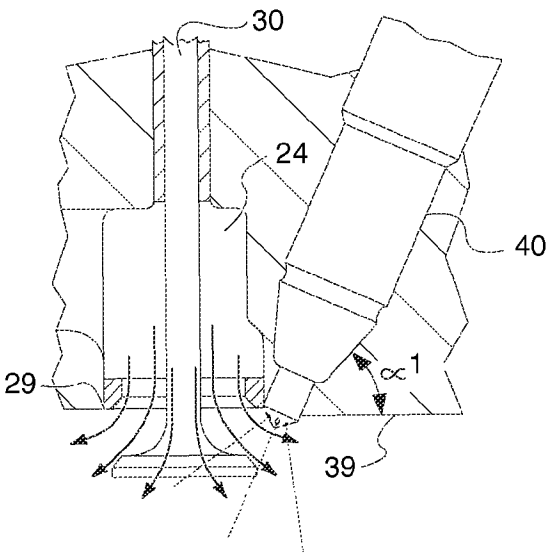
FIG. 2 is a schematical representation of a cross section of an embodiment of the engine of FIG. 1.
Figure 3:
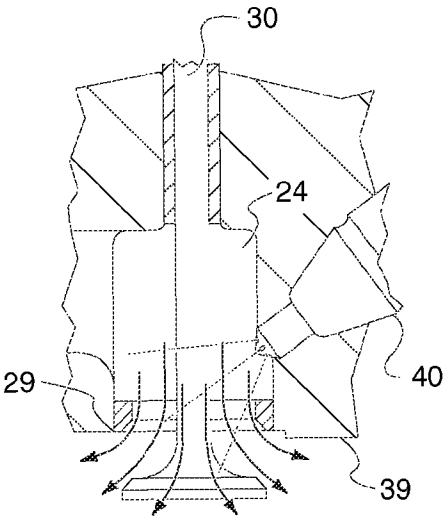
FIG. 3 is a schematical representation of a cross section of a further embodiment of the engine of FIG. 1.
Figure 4:
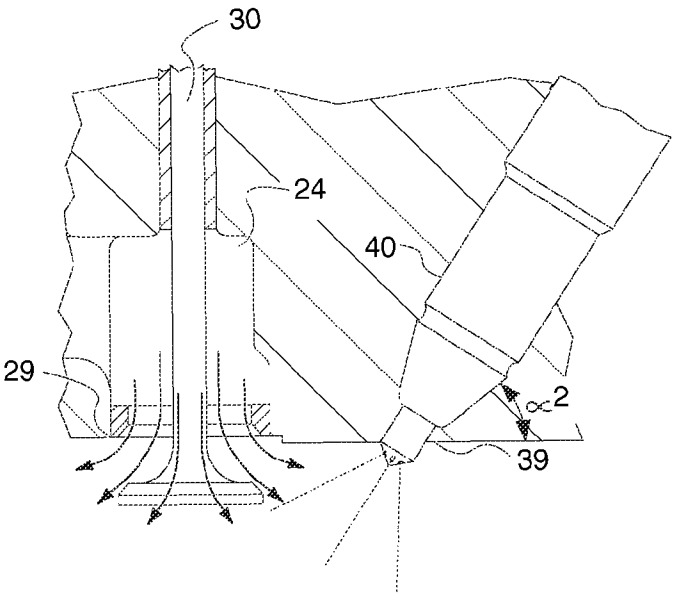
FIG. 4 is a schematical representation of a cross section of a further embodiment of the engine of FIG. 1.

FIGS. 2-4 detail exemplary embodiments of particular configurations of the injector 40 and the inlet port 29 with its associated inlet valve arrangement 30. In the embodiments shown in FIGS. 2-3, the inlet port 29 is configured to direct the fluid in a direction generally towards the second piston 18 in the second cylinder 14. Although portions of the inlet valve arrangement 30 may disturb the flow of the fluid entering the second cylinder 14 and portions of the fluid flow in the second cylinder 14 may be turbulent and/or travel sideways, the fluid flow is generally directed towards the second piston 18 so as to fill the second cylinder 14. The injector 40 may be configured to inject the fuel in a direction generally towards the second piston 18 in the second cylinder.

In an embodiment like that shown in FIG. 2, the fuel injection arrangement 38 is configured to inject fuel into the fluid upstream of the inlet port 29. In an embodiment like that shown in FIG. 3, the fuel injection arrangement 38 may be close coupled to the inlet port 29 and at an acute angle $\alpha_1$ relative to the cylinder head face 39 and may be configured to inject fuel into the fluid directly downstream of the inlet port 29. In an embodiment like that shown in FIG. 4, the fuel injection arrangement 38 is configured to inject fuel into the fluid directly downstream of the inlet port 29 albeit that the injector 40 may not be close coupled to the inlet port 29. In such a configuration, the fuel injection arrangement 38, and particularly the injector 40 may be at an angle $\alpha_2$, which may be smaller than angle $\alpha_1$ to ensure injection generally towards the entry point of the fluid into the second cylinder 14 where the fluid velocity is relatively high.

It is to be understood that although only one pair of first and second cylinders 12,14 and only single port & valve arrangements (20-22, 27-28, 29-30, 36-37) per cylinder are shown, multiples of each may be provided as preferred. Where two or more inlet ports 29 are provided for the second cylinder 14, the fuel injection arrangement 38 may include two or more fuel injectors 40, and/or a fuel injector 40 may have its injection nozzles configured such that the quantity of injected fuel is divided substantially equally over the two or more inlet ports 29, and/or the fuel injection may take place at a midpoint between the two or more inlet ports 29.

INDUSTRIAL APPLICABILITY

As commonly known, in conventional engines, the flow of fluid may be instigated by suction created via a piston in a downward stroke and, where applicable, via a turbocharger pushing fluid into the cylinder. The fluid flowing into the cylinder under such circumstances is at a relatively low pressure. In a design in accordance with the current disclosure, the fluid traveling through the inlet port 29 is at a very high pressure as it is positively pressurized and displaced by the first piston 16. This enables the fluid to travel into the second cylinder 14 and generally towards the second piston 18 with very high velocity. It was surprisingly found that it may be highly beneficial to inject fuel into the high velocity flow that is traveling in the direction generally towards the second piston 18. It was further found that cooling the flow of pressurized fluid between the first and second cylinders 12, 14 may be highly beneficial for the split-cycle concept.

An exemplary method of operating an internal combustion engine 10 in accordance with the current disclosure may be as follows.

It is to be noted that, where required, the control arrangement 42 may at least partially control any of the following. The split cycle may commence with causing an intake stroke in the first cylinder 12 so as to take in fresh air and, where desired, recirculated exhaust gas (EGR). During the intake stroke, the intake valve arrangement 22 may be open so as to allow fluid to flow through the intake port 20. Simultaneously, the release valve arrangement 28 may have closed off the release port 27. The method is further continued by causing a compression stroke whereby the intake port 20 may be closed off. During the whole of the compression stroke, or at least during a portion thereof, the release port 27 may be opened to release pressurized fluid from the first cylinder 12 into the transfer passage 24. From the transfer passage 24, the fluid is directed into the second cylinder 14 through the inlet port 29 by opening the inlet valve arrangement 30. Fuel may be introduced in the transfer passage 24 and/or be injected via the fuel injection arrangement 38 into the high velocity flow entering the second cylinder 14 for combustion with the fluid from the first cylinder 12. Combustion products may leave the second cylinder 14 during an exhaust stroke whereby the exhaust valve arrangement 37 may be open to allow combustion products to leave the second cylinder 14 via the exhaust port 36.

In one embodiment, the method includes cooling the fluid that is released from the first cylinder 12 (i.e. the pressurized fluid that is being transferred from the first cylinder 12 to the second cylinder 14) by using a cooling arrangement 32. In one embodiment, cooling the fluid may include causing a temperature drop of the fluid over the cooling arrangement 32 of about 40-60° K. It is to be understood that from hereon any discussion of the fluid in relation to the second cylinder 14 may include fluid which is either cooled or not cooled.

In one embodiment, the pressurized fluid released from the first cylinder 12 may temporarily be stored in the pressure storage device 34, which may act as a buffer to accommodate pressure spikes or peak demands in the system. In a system with both a pressure storage device 34 and a cooling arrangement 32, the pressure storage device 34 may be located either upstream or downstream of the cooling arrangement 32. In one embodiment where the pressure storage device 34 and the cooling arrangement 32 are close-coupled or integrated into one component, the fluid may be cooled whilst being in or passing through the pressure storage device 34.

Fluid from the transfer passage 24 is directed into the second cylinder 14 over a first period of time, which in one embodiment may be at least partially during the power stroke of the second cylinder 14. Fuel may be injected into the second cylinder 14 over a second period of time, which in one embodiment may be at least partially during the power stroke of the second cylinder 14. In one embodiment the first and second periods of time may at least partially overlap. In such an embodiment, fluid and fuel may enter the second cylinder 14 simultaneously.

As aforementioned, fluid directed into the second cylinder 14 may flow in a direction generally towards the second piston 18. Fuel is injected into the fluid whilst it is directed into the second cylinder 14 and/or whilst it is flowing generally towards the second piston 18. At this stage the fluid may be at a high velocity and may be highly turbulent but generally moving towards the second piston 18 and injecting fuel at this stage may aid the mixing and combusting process. In one embodiment the fuel may be injected in a direction generally towards the second piston 18, i.e. at least one component of direction is towards the second piston 18. As shown in FIG. 2, in one embodiment the method may include injecting the fuel into the fluid directly downstream of the inlet port 29. As shown in FIG. 3, in one embodiment the method may include injecting the fuel into the fluid upstream of the inlet port 29. As shown in FIG. 4, in one embodiment the method may include injecting the fuel into the fluid directly downstream of the inlet port 29 although the fuel injector 40 may not be close coupled to the inlet port 29.

Although the preferred embodiments of this disclosure have been described herein, improvements and modifications may be incorporated without departing from the scope of the following claims.

The invention claimed is:

1. A method of operating a combustion engine, comprising:

causing an intake stroke in a first cylinder;

causing a compression stroke in the first cylinder thereby creating a pressurized fluid;

releasing the pressurized fluid from the first cylinder;

cooling the pressurized fluid that is released to form a flow of cooled fluid;

directing the flow of cooled fluid into a second cylinder over a first period of time; and injecting fuel into the second cylinder over a second period of time, wherein the first and second periods of time at least partially overlap;

wherein the second cylinder is provided with an inlet valve configured to control the flow of cooled fluid into the second cylinder, the method further comprising injecting the fuel in the flow of cooled fluid upstream of the inlet valve only while the inlet valve is open so that a mixture of the flow of cooled fluid and the fuel enter the second cylinder.

2. The method according to claim 1, further comprising injecting the fuel into the cooled fluid while the cooled fluid is flowing in a direction generally towards a piston in the second cylinder.

3. The method according to claim 1, further comprising directing the cooled fluid and injecting the fuel in directions generally towards a piston in the second cylinder.

4. The method according to claim 1, wherein cooling the pressurized fluid that is released includes lowering a temperature of the pressurized fluid that is released by about 40 to 60 K.

5. The method according to claim 1, wherein the second cylinder is configured to receive the flow of cooled pressurized fluid from the first cylinder and to perform a power stroke and an exhaust stroke, the method including directing at least a portion of the flow of cooled fluid into the second cylinder during the power stroke.

6. The method of claim 1, wherein directing the cooled fluid into the second cylinder includes providing the cooled fluid to a transfer passage fluidly connecting the first cylinder to the second cylinder, and wherein the method further comprises selectively storing at least a portion of the pressurized fluid in a pressure storage device that is fluidly connected to the transfer passage via a pressure valve arrangement disposed to fluidly connect or isolate the pressure storage device and the transfer passage.

7. The method according to claim 5, comprising injecting the fuel during the power stroke.

8. An internal combustion engine comprising:

a pair of first and second cylinders configured to operate on a split-cycle principle, the first cylinder being configured to run intake and compression strokes, the second cylinder of the pair being configured to run power and exhaust strokes;

a passage fluidly connecting the first and second cylinders and configured to enable transfer of a flow of pressurized fluid between the first and second cylinders;

a cooling arrangement associated with the passage, the cooling arrangement operating to cool the flow of pressurized fluid;

a valve arrangement to control the flow of the pressurized fluid into the second cylinder over a first period of time;

a fuel injection arrangement configured to inject fuel into the second cylinder over a second period of time, the fuel injection arrangement being configured to inject the fuel into the flow of pressurized fluid upstream of the valve arrangement; and a control arrangement configured to control at least the fuel injection arrangement such that the first and second time periods at least partially overlap, wherein, during an overlap of the first and second time periods, an inlet valve of the valve arrangement is open so that a mixture of the flow of pressurized fluid and the fuel enter the second cylinder.

9. The internal combustion engine according to claim 8, wherein the valve arrangement includes at least one inlet port configured to direct the flow of pressurized fluid in a direction generally towards a piston in the second cylinder.

10. The internal combustion engine according to claim 8, wherein the fuel injection arrangement is configured to inject the fuel into the flow of pressurized fluid while the flow of pressurized fluid is flowing in a direction generally towards a piston in the second cylinder.

11. The internal combustion engine of claim 8, further comprising:

a pressure storage device that is fluidly connected to the passage; and a pressure valve arrangement disposed between the pressure storage device and the passage, said pressure valve arrangement configured to selectively fluidly connect or isolate the pressure storage device and the transfer passage.

12. The internal combustion engine of claim 9, wherein the at least one inlet port comprises at least two inlet ports and the fuel injection arrangement is arranged such that the fuel is injected into fluid flows of all of the at least two inlet ports.

13. A method of operating a combustion engine comprising:

causing an intake stroke in a first cylinder;

causing a compression stroke in the first cylinder thereby creating pressurized fluid;

releasing the pressurized fluid from the first cylinder;

cooling the pressurized fluid that is released from the first cylinder to form a cooled fluid;

directing the cooled fluid into a second cylinder;

injecting fuel into the second cylinder for combustion with the cooled fluid, wherein the fuel is injected upstream of the second cylinder only while an inlet valve to the second cylinder, through which the cooled fluid enters the second cylinder, is open so that a mixture of the cooled fluid and the fuel enter the second cylinder.

14. The method according to claim 13, wherein cooling the pressurized fluid that is released from the first cylinder includes lowering a temperature of the pressurized fluid by about 40-60 K.

15. The method according to claim 13, further including injecting the fuel into the pressurized fluid while the cooled fluid is directed into the second cylinder.

16. The method of claim 13, wherein directing the cooled fluid into the second cylinder includes providing the cooled fluid to a transfer passage fluidly connecting the first cylinder to the second cylinder, and wherein the method further comprises selectively storing pressurized fluid in a pressure storage device that is fluidly connected to the transfer passage via a pressure valve arrangement disposed to fluidly connect or isolate the pressure storage device and the transfer passage.

17. A method of operating a combustion engine comprising:

causing an intake stroke in a first cylinder;

causing a compression stroke in the first cylinder thereby creating pressurized fluid;

releasing the pressurized fluid from the first cylinder;

flowing the pressurized fluid into a second cylinder during a first period of time;

injecting fuel into the second cylinder during a second period of time wherein the first period of time and the second period of time at least partially overlap and wherein the fuel is injected into the pressurized fluid while the pressurized fluid is flowing upstream of the second cylinder in a direction generally towards a piston in the second cylinder only while an inlet valve, through which the cooled fluid enters the second cylinder, is open so that a mixture of the cooled fluid and the fuel enter the second cylinder.

18. The method according to claim 17, comprising flowing the pressurized fluid and injecting the fuel in directions generally towards a piston in the second cylinder.

19. The method according to claim 17, comprising cooling the pressurized fluid before it enters the second cylinder.

20. The method of claim 17, wherein directing the cooled fluid into the second cylinder includes providing the cooled fluid to a transfer passage fluidly connecting the first cylinder to the second cylinder, and wherein the method further comprises selectively storing pressurized fluid in a pressure storage device that is fluidly connected to the transfer passage via a pressure valve arrangement disposed to fluidly connect or isolate the pressure storage device and the transfer passage.

* * * * *

UNITED STATES PATENT AND TRADEMARK OFFICE

CERTIFICATE OF CORRECTION

PATENT NO. : 8,925,526 B2
APPLICATION NO. : 13/263303
DATED : January 6, 2015
INVENTOR(S) : Anders et al.

It is certified that error appears in the above-identified patent and that said Letters Patent is hereby corrected as shown below:

On the Title page, Item 60 (Related U.S. Application Data), line 1, delete "61/193,855," and insert -- 61/139,855, --.

In the Specification

Column 1, line 3, above "TECHNICAL FIELD" insert
-- RELATION TO OTHER PATENT APPLICATIONS This application is the U.S. National Phase of PCT/US2009/068469 filed Dec. 17, 2009, with the same title, and claims priority to U.S. Non Provisional Application No. 61/139,855, filed Dec. 22, 2008. --.

Signed and Sealed this
First Day of September, 2015

Michelle K. Lee

Michelle K. Lee
*Director of the United States Patent and Trademark Office*